United States Patent [19]

Fitjer

[11] Patent Number: 4,991,989

[45] Date of Patent: Feb. 12, 1991

[54] APPLICATOR DEVICE WITH SLIDE MEMBER

[75] Inventor: Holger Fitjer, Ansbach, Fed. Rep. of Germany

[73] Assignee: Georg Karl geka-brush GmbH, Bechhofen-Waizendorf, Fed. Rep. of Germany

[21] Appl. No.: 344,331

[22] Filed: Apr. 27, 1989

[30] Foreign Application Priority Data

Apr. 28, 1988 [DE] Fed. Rep. of Germany ..... 3814304

[51] Int. Cl.[5] ..... A46B 11/02

[52] U.S. Cl. ..... 401/155; 401/158; 401/161; 401/169; 401/269; 401/288

[58] Field of Search ..... 401/155, 161, 158, 162, 401/163, 169, 82, 83, 288, 269

[56] References Cited

U.S. PATENT DOCUMENTS

| | | | |
|---|---|---|---|
| 818,000 | 4/1906 | Stevenson | 401/155 |
| 2,445,571 | 7/1948 | Fuston | 401/155 |
| 2,820,979 | 1/1958 | Herter | 401/155 |
| 3,712,747 | 1/1973 | Prohomirecky | 401/155 |
| 4,826,341 | 5/1989 | Kwak | 401/161 X |

FOREIGN PATENT DOCUMENTS

| | | | |
|---|---|---|---|
| 1000291 | 2/1952 | France | 401/92 |
| 1007004 | 4/1952 | France | 401/160 |
| 1158903 | 2/1958 | France | 401/155 |

*Primary Examiner*—Steven A. Bratlie

*Attorney, Agent, or Firm*—Jordan and Hamburg

[57] ABSTRACT

An applicator device for a liquid, powder or pasty material includes a housing having a foil cartridge therein containing the liquid, powder or pasty material, and an ejector device is slidably mounted on the housing to provide for squeezing out the material from the foil cartridge for application at a desired site.

12 Claims, 2 Drawing Sheets

APPLICATOR DEVICE WITH SLIDE MEMBER

BACKGROUND OF THE INVENTION

The invention relates to an applicator device for liquid, powdered or pasty composition with an applicator, through which the composition that is in a dispenser cartridge can exit under the action of a metering element, especially for cosmetic and medical applications.

Such applicator devices are already known in widely differing branches of technology, for example in the form of tooth brushes with toothpaste accommodated in the handle, shaving brushes, shoe polishing brushes, or also nail polish brushes, which are screwed to the front of a dispenser bottle.

In the simplest cases, the liquid is discharged simply by inverting the device so that the liquid can flow out forwardly through the applicator. Apart from the fact that this can function reliably only for low-viscosity composition, such a procedure has the disadvantage that a meaningful seal is not possible and that the liquid can thus also run out unintentionally, causing considerable soiling. This is intolerable especially in cosmetic applications where such applicator devices are carried, for example, in a handbag. Furthermore, there are already metering devices, such as pistons for expelling the composition which can be moved through the cartridge by means of a screw displacement mechanism. Apart from the complicated mechanism, which is not well suited for simple mass-produced articles, this type of metering also has the disadvantage that complicated dispenser cartridges are needed.

SUMMARY OF THE INVENTION

It is therefore an object of the invention to provide an applicator device, which is equally suitable for cosmetic and medical applications, has a simple structure and a very simple mode of operation, can work with dispenser cartridges that also have a simple design, and which can not only process liquid, powdered, and pasty compositions, but also meter the outflow of these compositions accurately.

Pursuant to the invention, this objective is accomplished owing to the fact that the cartridge is a thin-walled foil cartridge, from which the composition can be squeezed by means of an ejector fastened on a slide, the ejector preferably being a curved springy bow fastened at the slide.

An inventive foil cartridge can be manufactured extremely simply and also inexpensively. By means of a curved ejector bow, such a cartridge makes it possible to squeeze out the composition accommodated therein very cleanly and completely without requiring a piston, which is required in known cartridges, but which is not provided here. The foil cartridge furthermore has practically no weight, so that in this fashion the weight of the applicator unit, as a whole, can be kept very low. This is especially advantageous for cosmetic uses.

So that the inventive foil cartridge can be inserted rapidly and simply into the applicator device, a further development of the invention provides for a housing, which is a divided longitudinally and constructed of two shells that can be locked together in detachable fashion.

In a development of the foil cartridge with a rearward bracket with a lug for hooking onto a holding pin of the lower shell, the foil cartridge, inserted in the lower shell, can be secured by very simply against longitudinal displacement. Thus, when the slide is moved with the ejector, the foil cartridge is not shifted and the composition is actually squeezed out. Simply by opening the device and turning the lower shell, a used-up cartridge can be ejected cleanly and hygienically. This is equally advantageous for cosmetic and for medical uses — although, of course, an inventive applicator device would also be usable for other purposes. Another extremely suitable development of the invention provides for an applicator, which is designed as a brush, sponge, spatula, small tube or the like, in which is fastened to the foil cartridge and covered by an easily removable sealing cap, so that the applicator itself is also discarded as the composition in the dispenser cartridge is used up. In this way, no soiled parts at all remain on the applicator device so that this device never needs to be cleaned even if used for a long time. It is merely necessary to insert a new dispenser cartridge, when needed, into the permanently clean double-shell device with the ejector slide. Before the first use, the sealing cap is removed from the applicator. This construction is not only extremely clean, but especially also very hygienic, so that it is particularly suitable for medical uses, for which a new applicator is available after every application — the content of the foil cartridge can indeed be chosen appropriately.

The construction of the longitudinally divided housing, consisting of a lower shell and of an upper shell containing the slide, is advisably such that the loosely superimposed shells, secured against axial longitudinal displacement for example, by mutually engaging fins, can be locked with respect to one another by means of the slide.

This interlocking of the two parts through the slide which carries the ejector can be achieved especially simply by providing ribs and grooves at the sides of the slide and the adjoining interior walls of the shells. These ribs and groves are disengaged only when the slide is in its retracted position, so that the shells can be opened in this position. After the slide has been shifted slightly in the direction of the front end, the ribs immediately engage the grooves and thus lock the shells together, as mentioned above.

Despite this interlock of the shells, which is achieved by means of the slide, there must be sufficient room for the foil cartridge. For this purpose, a further development of the invention provides that the slide is a plate that can be moved in a slot in the upper shell, with lateral, downwardly directed locking fins, which carry the ribs or preferably the grooves.

In place of the above-mentioned possible prevention of longitudinal displacement by mutually engaging fins on the shells, provisions can also be made with particular advantage to provide that the rear ends of the two shells with protrusions and recesses, which can be snapped together to form a pivot bearing for opening the shells. After the slide has been retracted into its rearward position, the two shells can be opened without falling apart completely; the foil cartridge, and possibly the associated applicator, can then be replaced. After a new foil cartridge has been inserted, the shells are closed, and the slide is moved somewhat forwards to lock the shells together. To prevent the shells from falling apart unintentionally by a spontaneous backwards motion of the slide into its rearmost position, provision can also be made so that the slide is guided so as to be longitudinally movable with an appropriate snug fit or else also so that the slide, in its rearmost position, is subject to the action of a spring, which braces it forwards so that it can reach the retracted position in which it is possible to open the shells with respect to one another only by exerting an external pressure.

Finally, it also lies within the scope of the invention to provide a flexible clamping seal in the region of the outlet end of the foil cartridge. This clamping seal can be opened by the pressure exerted by the ejector on the composition. Such a clamping seal may be part of the housing, which consists of the two shells or part of the foil cartridge itself, for example, a plastic clamp fitting, which opens only under pressure. In this fashion, the inventive applicator device can stored cleanly and safely, even when compositions of very low viscosity are handled, and any risk of the composition flowing out it prevented. Every time that a desired quantity of substance has been squeezed out with the help of the slide, the slide is moved back slightly to relieve the pressure on the foil cartridge and the composition accommodated therein, so that the clamping element mentioned above reliably seals the opening in the region of the applicator.

In this connection, it is understood as a matter of course that a cap is suitably provided for the applicator end of such an applicator device, and that this cap covers the applicator at a distance.

Other advantages, features, and details of the invention arise out of the following description of an example of the operation, as well as out of the drawings.

DESCRIPTION OF THE PREFERRED EMBODIMENTS

Figure 1:
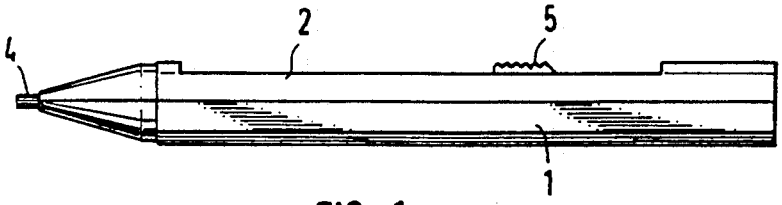
FIG. 1 is a side view of an inventive applicator device.
Figure 2:
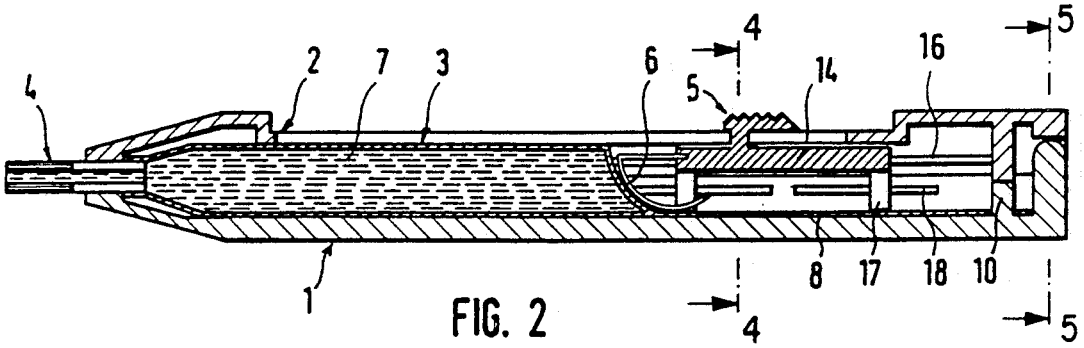
FIG. 2 is an enlarged longitudinal sectional view through the applicator device of FIG. 1.

The example of the operation of an inventive applicator device shown in the Figures comprises a longitudinally divided housing with a lower shell 1 and an upper shell 2 housing a foil cartridge 3, with an applicator 4 fastened at the front end, as well as an ejector 6 which is designed as a bent plate spring and which is attached to a slide 5.

Figure 3:
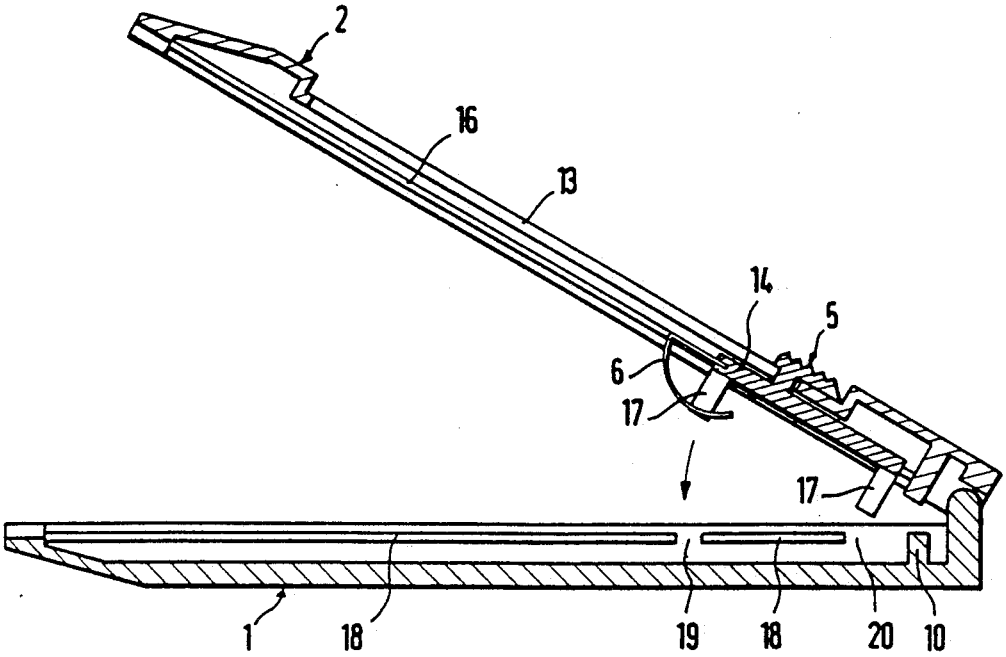
FIG. 3 is a sectional view of the device without the inserted cartridge an in an open replacement position for the cartridge.
Figure 4:
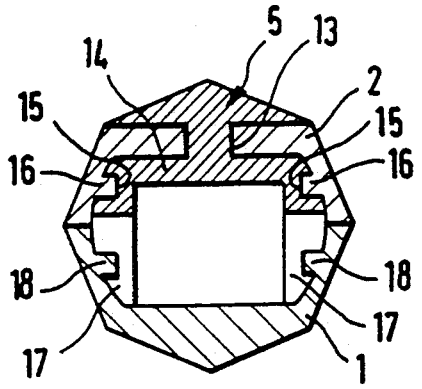
FIG. 4 is a cross-sectional view taken along the line 4—4 in FIG. 2.
Figure 5:
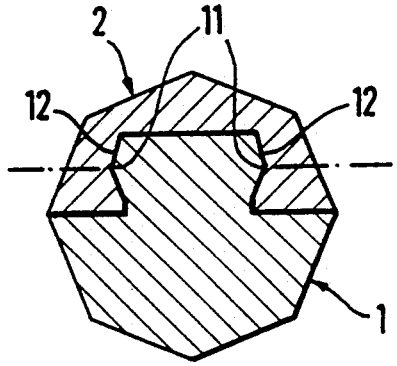
FIG. 5 is a sectional view taken along the line 5—5 in FIG. 2 through the end, which is designed as a rotary bearing.
Figure 6:
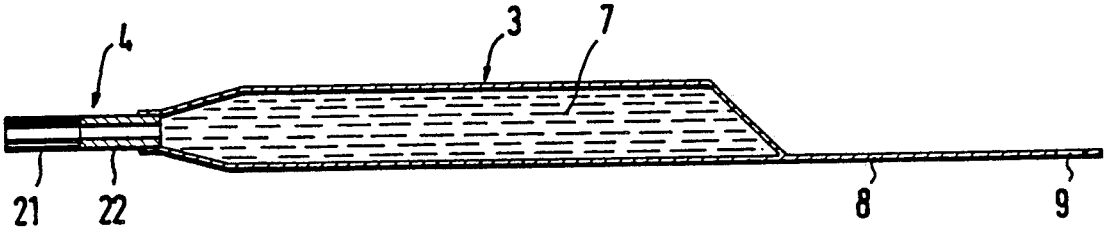
FIG. 6 is a sectional representation of the foil cartridge with an applicator in the form a of a brush fastened to the cartridge.

The thin-walled foil cartridge, which holds the composition 7 that is to be applied, has a bracket 8 with a lug 9 at its rear end. The lug 9 can be hooked over a holding pin 10 of the lower shell 1. At its rear end, the lower shell 1 has outwardly directed protrusions 11 and the upper shell 2 correspondingly shaped recesses 12, which engage one another so as to form a pivot bearing for opening the shells, as can be seen from FIG. 3.

In the embodiment shown, the slide 5, which carries an ejector 6, is used to releasably lock the closed shells. The slide 5 comprises a plate 14, which can be shifted in gliding fashion in an elongated slot 13 in the upper shell 2. The plate 14 is provided on both sides with grooves 15, which are engaged by ribs 16 that are integrally molded to the adjacent side walls of the upper shell. Furthermore, downwardly directed locking ribs 17 are integrally molded to both sides. These ribs likewise have grooves on their outside which are associated with ribs 18 at the interior walls of the lower shell 2. The ribs 18, moreover have recesses 19 and 20 in such a fashion that the grooves of the holding fins 17 are disposed in these gaps in the retracted position of the slide, and thus do not engage the ribs 18, so that the upper shell can be opened. Whenever the slide is moved forwards or rearwards from this position, The ribs 18 of the lower shell engage the grooves of the holding fins 17, so that the two shells 1 and 2 are then actually securely locked together. To prevent the slide reaching the opening position described above spontaneously, a spring may be provided, which is not shown in the Figures for reasons of clarity and which can be integrally molded as a plastic spring to the lower or upper shell. This spring always braces the slide in a locking position which lies further forwards, so that the unlocking position can be reached only through pressure exerted by the user against the force of the spring.

A clamping seal could be provided in similar fashion in the area of the front end of the foil cartridge 3 either in the cartridge itself or also in the housing. This clamping seal closes the cartridge and opens it only when the composition 7 is subjected to a certain pressure in order to open the clamping seal. This pressure is exerted by the user on the composition over the slide 5 and the ejector 6. In this fashion, the foil cartridge could be sealed in an especially clean and tight manner, so that the risk of spontaneous outflow and contamination is reliably prevented. For the sake of clarity, this simple construction of a clamping seal also has not been drawn in the figures.

Figure 7:
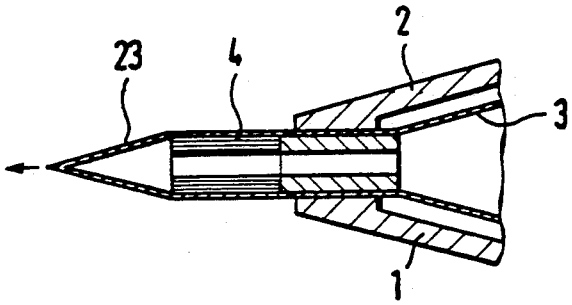
FIGS. 7 and 8 show various magnified sectional views of the applicator region with two design variants of a sealing cap which covers the applicator.
Figure 8:
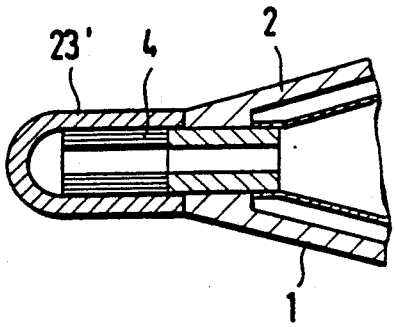

In the example shown, the applicator 4 is a brush 21, which is connected to the foil cartridge 3 through a welded-on tube 22. Naturally, any other type of applicator could be used, such as a sponge, an application spatula with a hole, or the like. Advisably, provisions are made to cover the applicator 4 or a new foil cartridge with a sealing cap 23 or 23'. This sealing cap 23 or 23' can either be a tear-off thin foil cap as shown in FIG. 7, or also a stick-on plastic cap 23', as in FIG. 8. This sealing cap 23, 23' covers the new foil cartridge and thus prevents the composition held therein exiting. In addition to this cap, a cap associated with the applicator unit itself naturally will also be provided. This latter cap can be placed over the front end of the device, in order to cover the applicator and the composition adhering to it.

I claim:

1. An applicator device for a liquid cosmetic material comprising an elongated housing means having an elongate axis, a foil cartridge containing said material disposed in said housing means, said foil cartridge comprising a foil container and an applicator means fixed to said foil container, a sealing cap disposed on said applicator means, and ejector means mounted on said housing means for slidably movement in an axial direction for squeezing out said material from said foil cartridge to said applicator means upon removal of said sealing cap.

2. An applicator device according to claim 1, wherein said ejector means comprises a slide member and a spring means carried by said slide member, said spring means engaging said foil cartridge as said material is squeezed out of said foil cartridge, said spring means having a leading surface which is curved and which engages said foil cartridge to effect said squeezing out of said material.

3. An applicator device according to claim 1, wherein said housing means comprises two housing sections which can be at least partially separated to provide for inserting said cartridge into said housing means, said ejector means comprising a slide member slidably mounted on one of said housing sections, said slide member being slidable between a retracted position and a plurality of extended positions, said slide member having first engageable means, said other housing section having a second engageable means which engage said first engageable means when said slide member is in said extended positions such that said slide member effects securement of said two housing sections to one another.

4. An applicator device according to claim 3, wherein one of said first and second engageable means comprises a groove and the other of said first and second engageable means comprises a projection slidable in said groove.

5. An applicator device according to claim 4, wherein said second engageable means extends longitudinally along some parts of said other housing section and not along other parts to thereby define a gap, said slide member having at least one transverse projection on which said first engageable means is located, said transverse projection being generally aligned with said gap when said slide member is in said retracted position to thereby enable said two housing sections to be at least partially detached from one another when said slide member is in said retracted position.

6. An applicator device according to claim 1, wherein said foil cartridge and said housing means have securement means for securing said foil cartridge to said housing means, said securement means comprising a projection on said housing means and an extension on said foil cartridge which has an opening which receives said projection.

7. An applicator device according to claim 1, wherein said applicator means is selected from the group consisting of a brush, sponge, spatula and tube.

8. An applicator device according to claim 1, wherein said sealing cap is detachably mounted on said housing means.

9. An applicator device according to claim 1, wherein said sealing cap is a foil cap extending from said foil cartridge.

10. An applicator according to claim 1 further comprising a seal disposed about said applicator means, said seal being openable by the pressure of the material being squeezed out of the foil cartridge.

11. An applicator according to claim 1, wherein said foil container has a forward end and a rear end, said applicator means being fixed to said forward end, said rear end having a rear extension, and securement means on said housing means operable to engage and secure said rear extension to said housing means.

12. An applicator according to claim 11, wherein said rear extension of said foil container comprises a flat section of foil.

* * * * *